US008869787B2

(12) United States Patent
Thölking et al.

(10) Patent No.: US 8,869,787 B2
(45) Date of Patent: Oct. 28, 2014

(54) HAND-OPERATED IMPLEMENT COMPRISING A CUTTING CHAIN FOR CUTTING MINERAL AND METAL MATERIALS

(71) Applicant: Andreas Stihl AG & Co. KG, Waiblingen (DE)

(72) Inventors: Hannah Thölking, Stuttgart (DE); Horst Otterbach, Waiblingen (DE); Helmut Zimmermann, Berglen (DE); Jens Kreutzer, Stuttgart (DE); Jonas Lank, Winnenden (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 210 days.

(21) Appl. No.: 13/650,153

(22) Filed: Oct. 12, 2012

(65) Prior Publication Data

US 2013/0319392 A1 Dec. 5, 2013

(30) Foreign Application Priority Data

May 31, 2012 (DE) ..... 10 2012 010 977

(51) Int. Cl.
*B28D 1/08* (2006.01)
*B27B 17/02* (2006.01)

(52) U.S. Cl.
CPC ..... *B28D 1/082* (2013.01); *B27B 17/02* (2013.01)
USPC ..... 125/21; 125/12; 451/444; 30/382; 83/832

(58) Field of Classification Search
CPC ..... B28D 1/124; B28D 1/088; B28D 1/08; B28D 5/045; B28D 1/082; B23D 61/185
USPC ..... 125/21, 12; 83/832, 830; 30/382, 381; 451/444, 451, 453, 455, 298, 355
See application file for complete search history.

(56) References Cited

U.S. PATENT DOCUMENTS

| | | | | |
|---|---|---|---|---|
| 2,348,612 A | | 5/1944 | Deacon | |
| 3,596,689 A | * | 8/1971 | Oehrli | 30/138 |
| 3,921,490 A | * | 11/1975 | Dolata et al. | 83/833 |
| 4,382,334 A | * | 5/1983 | Reynolds | 30/386 |

(Continued)

FOREIGN PATENT DOCUMENTS

| | | |
|---|---|---|
| DE | 1 933 366 | 2/1966 |
| DE | 20 2011 051 060 U1 | 11/2011 |

(Continued)

*Primary Examiner* — George Nguyen
(74) *Attorney, Agent, or Firm* — Gudrun E. Huckett

(57) ABSTRACT

A hand-operated implement has a guide bar on which is fitted a cutting chain for cutting mineral and metal materials. The cutting chain is driven around the guide bar by a chain sprocket. The chain sprocket is arranged in a chain sprocket chamber which is delimited by a chain sprocket cover. A cutting element has an outer side facing a sidewall of the chain sprocket cover which lies in a first notional plane. The distance between the sidewall and the first notional plane measured perpendicular to the first notional plane and centrally between the top of the cutting element and the peripheral wall is less than approximately 0.8 cm over at least 30% of the section between a second notional plane containing the central axis of a fixing bolt on the guide bar and the exit opening at which the cutting chain leaves the chain sprocket chamber.

18 Claims, 6 Drawing Sheets

(56) References Cited

U.S. PATENT DOCUMENTS

| | | | | |
|---|---|---|---|---|
| 4,463,630 | A * | 8/1984 | Turner | 76/80.5 |
| 4,593,591 | A * | 6/1986 | Beerens | 83/834 |
| 4,756,221 | A | 7/1988 | Nitschmann et al. | |
| 4,776,826 | A * | 10/1988 | Scott | 474/156 |
| 4,816,010 | A * | 3/1989 | Reynolds | 474/92 |
| 5,184,598 | A * | 2/1993 | Bell | 125/21 |
| 6,112,419 | A | 9/2000 | Uhl et al. | |
| 6,186,136 | B1 * | 2/2001 | Osborne | 125/21 |
| 6,283,112 | B1 * | 9/2001 | Berglund | 125/21 |
| 6,435,070 | B1 | 8/2002 | Weber | |
| 7,089,670 | B2 * | 8/2006 | Donnerdal | 30/371 |
| 7,959,498 | B2 * | 6/2011 | Schrottner | 451/449 |
| 8,256,335 | B1 | 9/2012 | Canon | |
| 2001/0042311 | A1 * | 11/2001 | Kondo et al. | 30/386 |
| 2008/0034597 | A1 * | 2/2008 | Pfleiderer et al. | 30/382 |
| 2009/0077815 | A1 * | 3/2009 | Wolf et al. | 30/383 |

FOREIGN PATENT DOCUMENTS

| | | | |
|---|---|---|---|
| EP | 0 337 753 | A2 | 10/1989 |
| EP | 0 474 446 | A2 | 3/1992 |
| WO | 2008/008900 | A2 | 1/2008 |

* cited by examiner

HAND-OPERATED IMPLEMENT COMPRISING A CUTTING CHAIN FOR CUTTING MINERAL AND METAL MATERIALS

BACKGROUND OF THE INVENTION

The invention relates to a hand-operated implement comprising a cutting chain for cutting mineral and metal materials. The implement comprises a housing in which is positioned a drive motor. A guide bar is fixed to the housing and a cutting chain for cutting mineral and metal materials is fitted to the guide bar. The cutting chain comprises at least one cutting element which has a top facing away from the guide bar. The cutting chain is driven around the guide bar in a direction of travel via a chain sprocket by a drive motor. A device for feeding liquid to the cutting chain is provided. The guide bar has a longitudinal central axis bisecting the cutting chain adjacent to the chain sprocket in a first turning area and adjacent to the nose of the guide bar in a second turning area. The cutting chain is driven in a first section from the first turning area to the second turning area in the direction of travel and in a second section from the second turning area to the first turning area in the direction of travel. The chain sprocket is positioned in a chain sprocket chamber which is delimited by a chain sprocket cover. The chain sprocket chamber has a sidewall configured on the chain sprocket cover. The cutting element has on its top a longitudinal edge facing the sidewall of the chain sprocket cover. The cutting chain enters the chain sprocket chamber at an entry opening and exits the chain sprocket chamber at an exit opening. At least one outlet opening is formed at a peripheral wall of the chain sprocket chamber. The cutting element has an outer side facing the sidewall which lies at least partially in a first notional plane. The guide bar is fixed to the housing at at least one fixing bolt. The implement has a second notional plane that is perpendicular to the longitudinal central axis of the guide bar and contains the central axis of fixing bolt.

When cutting mineral materials such as stone or concrete, for example, using a cutting chain, the material is removed in an abrasion process by cutting elements on the cutting chain. This process creates a fine dust or abrasion grit. Considerable heat is produced during the abrasion process and can lead to increased wear at the cutting chain. During operation cutting chains for cutting mineral materials are therefore usually cooled with a liquid such as water, for example. The water also serves to bind together and carry away the abrasion dust which is created.

An implement comprising a cutting chain for cutting cement, etc. comprising a water supply device is known from U.S. Pat. No. 6,186,136 B1. Outward facing deflection plates which carry away the water outwards and downwards are provided on the chain sprocket cover to remove the mud created during operation.

It has been shown that very large quantities of water are required for cooling and to carry away abrasion grit when using such an implement.

The object of the invention is to create an implement comprising a cutting chain for cutting mineral or metal materials of the generic type in which the need for liquid is reduced.

SUMMARY OF THE INVENTION

This object is achieved by means of a hand-operated implement of the aforementioned kind comprising a cutting chain for cutting mineral or metal materials, wherein the distance between the sidewall and the first notional plane measured perpendicular to the first notional plane and centrally between the top of the cutting element and the peripheral wall is less than approximately 0.8 cm over at least 30% of the section between the second notional plane and the exit opening.

It has been shown that during operation the liquid such as water, for example, is carried along by the cutting chain. In comparison to the oil which is used for lubrication in standard chain saws for cutting wooden materials, the viscosity of water is very low. This means that water can be sprayed away from the cutting chain easily during operation. This water has to be replaced in order to guarantee sufficient cooling and lubrication. The liquid can be sprayed forwards past the cutting chain laterally in particular at the exit from the chain sprocket chamber. The water which flows laterally past the cutting chain and out into the environment is thus no longer available to continue cooling and lubricating the cutting chain. A cutting element for cutting mineral materials is of solid design, while a cutting element for cutting wood is usually made of bent sheet metal, for example, rather than being solid. The volume of a cutting element for cutting mineral materials is therefore large in comparison with the volume of a cutting element in a chain saw. The cross-sectional area of a cutting element for cutting mineral materials in a cross-section perpendicular to the direction of travel of the cutting chain is also clearly larger than the same cross-sectional area of a cutting element for cutting wood.

In order to reduce the liquid needed for an implement for cutting mineral and metal materials, as large as possible a part of the liquid sprayed away by the cutting chain is collected in the chain sprocket cover and returned to the cutting chain in a targeted manner. The liquid or mud is advantageously returned to the cut in the workpiece in a focussed manner. This is achieved by reducing the distance between the sidewall and the cutting element above the top of the cutting element in the area before the outlet opening. During operation the cutting chain lifts off the guide bar due to centrifugal forces. During operation the cutting element is therefore positioned in an area which lies above the cutting element when the cutting chain is at a standstill. It has been shown that in order to return the liquid from the chain sprocket chamber to the cut in a properly focussed manner, the distance halfway between the top of the cutting element and the peripheral wall of the chain sprocket chamber must be small. The outer side of the cutting element faces the sidewall of the chain sprocket cover. The outer side of the cutting element lies in a first notional plane. The lateral distance from the cutting element to the chain sprocket cover is measured perpendicular to the first notional plane between the sidewall of the chain sprocket cover and the first notional plane. In this arrangement the lateral distance in the first notional plane is measured centrally between the top of the cutting element and the peripheral wall.

The distance between the sidewall and the first notional plane over at least 30% of the stretch between the second notional plane and the exit opening is less than approximately 0.8 cm. This allows a focussed flow of liquid back to the chain and into the cut. In particular, the distance over at least 50% and advantageously over at least 70% of the stretch between the second notional plane and the outlet opening is less than approximately 0.8 cm. The distance over the entire section from the second notional plane to the outlet opening is advantageously less than approximately 0.8 cm. In this arrangement the second notional plane is a plane which contains the central axis of a fixing bolt for the guide bar and is perpendicular to the longitudinal central axis of the guide bar. The guide bar is advantageously fixed to the housing at a first fixing bolt facing the chain sprocket and at a second fixing bolt facing the tip or nose of the guide bar. The second notional plane contains in particular the first fixing bolt facing the chain sprocket. However, fixing the guide bar with only one fixing bolt can also be advantageous. The distance between the sidewall and the first notional plane at the outlet opening is advantageously less than approximately 0.8 cm. This prevents the jet of liquid from dispersing at the outlet opening.

The first notional plane is advantageously positioned parallel to the plane of extension (length, height) of the guide bar and perpendicular to the axis of rotation of the chain sprocket. However, the first notional plane can also be inclined towards the plane of the guide bar if the outer side of the cutting element runs at an angle. The course of the outer side of the cutting clement can also be curved or irregular. In such a case the first notional plane is a plane which approximately contains the outer side of the cutting element. The guide chamber formed above the cutting element is comparatively narrow due to the short distance of less than approximately 0.8 cm. At the outlet opening there is advantageously also a short distance between a further notional plane containing the inner side of the cutting element opposite the outer side and the housing of the implement. The distance between the further notional plane and the housing of the implement is advantageously less than approximately 0.8 cm. The distance between the further notional plane and the housing is advantageously approximately the same as the distance between the first notional plane and the sidewall of the chain sprocket cover. The cutting chain is thus positioned approximately centrally between the sidewall and the housing of the implement and the liquid is conveyed symmetrically from both sides to the cutting chain. Due to the large volume and large cross-sectional area of a cutting element for cutting mineral materials, the free cross-sectional area in the area of the outlet opening is also clearly reduced. Due to the short distance the liquid at the outlet opening is guided back to the cutting chain in a targeted manner where it becomes available for cooling and for carrying away abrasion grit once again. The volume of liquid provided can thus be reduced while maintaining its cooling and lubricating effect. Surprisingly, it has been shown that there is no increase in wear at the cutting chain despite the reduced need for water. The top of the cutting element is the area of the cutting element facing away from the guide bar and towards the peripheral wall which is designed to engage with the workpiece.

The cutting chain is advantageously used primarily for cutting mineral materials such as stone or concrete. However, it can also be used to cut through metal materials, in particular reinforcing rods in concrete. The metal material is advantageously embedded in the mineral material. The cutting chain removes the material using an abrasion process.

The distance between the sidewall and the first notional plane measured perpendicular to the first notional plane is advantageously between approximately 80% and approximately 120% of the width of the top of the cutting element measured parallel to the axis of rotation of the chain sprocket. The short distance ensures that liquid can be conveyed to the cutting chain and carried along by the cutting chain effectively. The distance between the longitudinal edge of the cutting element and the sidewall measured at the level of the top is advantageously also between approximately 80% and approximately 120% of the width of the top of the cutting element. In this arrangement the longitudinal edge of the cutting element is the edge facing the sidewall of the chain sprocket cover at the top of the cutting element. The longitudinal edge of the cutting element is the edge between the top and the outer side of the cutting element. A distance of the order of magnitude of the width of the top of the cutting element can be guaranteed by ensuring that the top of the cutting element is unable to come into contact with the sidewall.

The distance between the sidewall and the longitudinal edge of the cutting element at the outlet opening measured parallel to an axis of rotation of the chain sprocket is advantageously less than approximately 0.8 cm. It has been shown that liquid carried along by the cutting chain and present in the chain sprocket chamber can be conveyed effectively to the cutting chain by providing a short lateral distance between the longitudinal edge of the cutting element and the sidewall. The water fed to the chain sprocket chamber can thus largely be conveyed back to the cutting chain.

The guide bar is advantageously fixed to the housing at a first fixing bolt facing the chain sprocket and at a second fixing bolt facing the tip or nose of the guide bar. The implement has a second notional plane which is perpendicular to the longitudinal central axis of the guide bar and contains the central axis of the first fixing bolt. Between the second notional plane and the outlet opening, the distance from the sidewall of the chain sprocket cover to the first notional plane measured at the half-way point advantageously changes by less than 20% and in particular by less than 10% of the distance to the outlet opening. In this arrangement the half-way point is measured centrally between the top of the cutting element and the peripheral wall. The sidewall from the second notional plane to the outlet opening is thus positioned in an area delimited by two further notional planes, these two further planes being parallel to the plane of the guide bar and the distance between the two further planes being less than approximately 20% of the distance between the first notional plane and the sidewall at the outlet opening. The liquid can be conveyed to the cutting chain effectively because the sidewall runs approximately parallel to the guide bar. In this arrangement the sidewall advantageously runs largely evenly, avoiding any jumps, edges or other abrupt changes in cross-section and constricted areas which could lead to a nozzle effect. The term nozzle effect is used here to refer to the dispersion of the jet of liquid due to changes in the free cross-section for the liquid. An even sidewall course permits the liquid to be conveyed smoothly in a targeted manner and prevents a nozzle effect. This reduces the amount of liquid which needs to be supplied.

The sidewall of the chain sprocket cover advantageously runs constantly from the second notional plane to the outlet opening along the length of the cutting chain. In this arrangement the sidewall is thus constant in the mathematical sense and the sidewall has no jumps or edges along the length of the cutting chain. The length of the cutting chain corresponds to a line connecting the centre points of the connecting bolts on the cutting chain. In this arrangement the sidewall need not be configured as a flat surface but can also be curved, the curve advantageously being as small as possible. In particular, the curve is configured such that the angle between a tangent at the lateral surface and the plane of the guide bar is less than 45° and in particular less than 30° at every point on the lateral surface from the notional plane to the outlet opening. In this arrangement the angle is measured in a plane which is parallel to the plane of the guide bar and runs parallel to the length of the cutting chain. The plane can run in a curve matching the course of the cutting chain. The amount of the derivative of a function describing the course of the sidewall in this plane is thus less than 1, the x-axis of the function running along the length of the cutting chain. In particular, the sidewall runs approximately parallel to the sidewall from the second notional plane to the outlet opening.

The distance between the sidewall and the longitudinal edge of the cutting element is advantageously less in the first section at the outlet opening than in the notional plane. The distance between the sidewall and the longitudinal edge of the cutting element decreases in particular from the notional plane to the outlet opening. This allows liquid in the chain sprocket chamber to be guided in a targeted manner to the cutting chain. The distance between the sidewall and the longitudinal edge of the cutting element along a stretch from the notional plane to the outlet opening is advantageously less than approximately 1 cm. The fact that the distance between the sidewall and the longitudinal edge of the cutting element is comparatively short over the whole section from the notional plane to the outlet opening means that liquid can be guided to the cutting edge effectively. The distance is advantageously less than approximately 0.8 cm from the notional plane to the outlet opening.

A simple design with good guidance of liquid to the cutting chain is achieved if the inner contour of the chain sprocket cover delimiting the chain sprocket chamber has a step running along the length of the guide bar adjacent to the first section. This step is advantageously configured so as to reduce the width of the chain sprocket chamber in the area of the step. When the implement is in the usual set-down position, a guide chamber is advantageously formed above the top of the cutting element. In this arrangement the step delimits in particular the guide chamber. The liquid is conveyed to the cutting chain in the guide chamber. It has been shown that a narrowing of the width of the chain sprocket chamber to guide the liquid to the cutting chain in a targeted manner is advantageous, particularly in the area above the top of the cutting element. At the outlet opening the guide chamber advantageously has a mean width which is less than approximately 70% of the greatest width of the chain sprocket chamber. The mean width of the guide chamber is advantageously no more than 50% of the greatest width of the chain sprocket chamber. In this arrangement the mean width is measured parallel to the axis of rotation of the chain sprocket halfway between the top of the cutting element and the peripheral wall of the chain sprocket chamber. The liquid supplied is sprayed outwards by the cutting chain. Due to the narrowed width of the guide chamber above the top of the cutting element, the liquid sprayed outwards is guided back to the cutting chain in a targeted manner.

The distance measured between the top of the cutting element and a peripheral wall of the chain sprocket chamber at the entry opening is advantageously at least approximately 1.5 cm. The distance between the top of the cutting element and the peripheral wall at the entry opening is advantageously as large as possible so that a large part of the mud sprayed towards the chain sprocket chamber by the cutting chain is collected at the entry opening and guided into the chain sprocket chamber. It is thus possible to minimise liquid loss at the entry opening.

In order to avoid mud escaping between the chain sprocket cover and the housing of the implement, certain sections at least of the connection between the chain sprocket cover and the housing must be made as watertight as possible. To this end the implement is provided with a rib which extends into the chain sprocket cover and is positioned adjacent to a wall of the chain sprocket cover. The two adjacent walls acts as a form of labyrinth seal, sealing the chain sprocket chamber. In particular, the chain sprocket chamber is provided with a recess into which the rib on the implement projects. This creates a good seal and largely prevents mud from escaping in the area of the seal. The rib is positioned in particular in an area of the chain sprocket cover in which high pressure prevails in the chain sprocket chamber during operation. The rib advantageously extends adjacent to the first section of the cutting chain, in particular in the area of the second notional plane and from the second notional plane towards the outlet opening. The guide chamber configured between the top of the cutting element and the peripheral wall advantageously decreases in size from the entry opening to the exit opening. The pressure in the chain sprocket chamber is thus higher in the first section of the cutting chain. The configuration of a sealing rib in particular in the first section of the cutting chain is therefore advantageous. In this arrangement the rib extends as close as possible to the exit opening.

An outlet opening is advantageously configured on a peripheral wall of the chain sprocket chamber. Mud formed from liquid and abrasion grit can be carried away from the chain sprocket chamber via the outlet opening. The distance from the top of the cutting element to the peripheral wall measured in the plane of the guide bar with the exception of the area of the outlet opening over the entire section from the entry opening to the exit opening is advantageously less than approximately 3 cm. The comparatively short distance between the top of the cutting element and the peripheral wall ensures that a large part of the liquid sprayed outward by the cutting chain during operation can be guided back to the cutting chain. The distance between the top of the cutting element and the peripheral wall is in particular less than approximately 2.5 cm.

In particular, the chain sprocket chamber is of closed configuration with the exception of the entry opening, the exit opening and the outlet opening. This ensures that only small amounts of liquid are able to leave the chain sprocket chamber. Thanks to the design of the chain sprocket chamber a large part of the liquid sprayed into the chain sprocket chamber by the cutting chain can be guided back to the cutting chain where it is once more available for lubrication and cooling. The outlet opening is advantageously comparatively small. In particular, the outlet opening extends over an angle of less than approximately 90° about the rotation of rotation of the chain sprocket. An angle of approximately 60° is regarded as particularly advantageous. Advantageously the outlet opening does not extend over the entire width of the chain sprocket chamber. In particular, the outlet opening extends over less than approximately two thirds of the width of the chain sprocket chamber. The amount of liquid or mud leaving via the outlet opening can be kept particularly low if the outlet opening extends over less than half the width of the chain sprocket chamber.

The start of the outlet opening positioned at the front in the direction of travel of the cutting chain is advantageously narrower than the end of the outlet opening positioned at the rear in the direction of travel. The outlet opening advantageously widens gradually and in particular continuously with a straight or curved course of the peripheral wall at the outlet opening. The fact that the outlet opening extends over only a part of the width of the chain sprocket chamber and opens gradually in the direction of travel of the cutting chain minimises the loss of liquid at the outlet opening. The outlet opening is advantageously made as long as possible in the direction of travel of the cutting chain so as to ensure a smooth transition and a gradual opening of the outlet opening in the direction of travel of the cutting chain. The start of the outlet opening positioned at the front in the direction of travel is advantageously positioned approximately in the flow direction of the second section of the cutting chain, i.e. as an extension of the second section of the cutting chain. The flow direction of the cutting chain is the direction in which the water is carried along the second section of the cutting chain by the cutting chain.

The implement has a third notional plane which contains the tops of the cutting elements of the second section of the cutting chain and, more precisely, the tops of the cutting elements of the straight area of the second section of the cutting chain before entry into the chain sprocket chamber. The start of the outlet opening is located a distance of less than approximately 1 cm and in particular less than approximately 0.5 cm from the third notional plane. In this arrangement the distance is measured perpendicular to the third notional plane. This enables mud carried into the chain sprocket chamber by the cutting chain to leave via the outlet opening with little contact with the chain sprocket cover. It has been shown that particles carried in the mud can cause considerable wear on the chain sprocket cover. This wear is reduced by the appropriate configuration of the outlet opening. To reduce the wear at the end of the outlet opening, the end of the outlet opening is delimited by an elastic element. The elastic element is advantageously an insert made of an elastomer or rubber fixed to the chain sprocket cover.

A guide section is advantageously configured on the peripheral wall before the start of the outlet opening seen in the direction of travel of the cutting chain. The guide section is in particular configured such that it forms an angle of more than approximately 70° with a radial to the axis of rotation of the chain sprocket. The guide section is advantageously configured approximately perpendicular to the radial to the axis of rotation of the chain sprocket. As a result the guide section runs approximately parallel to the direction of movement of the adjacent area of the cutting chain. This means that a large part of the liquid sprayed outward in the chain sprocket chamber by the cutting chain is guided away from the outlet opening by the guide section and only small amounts of liquid enter the environment through the outlet opening. The design of the outlet opening as described in conjunction with the design of the guide section minimise liquid consumption whilst at the same time keeping wear at the outlet opening as low as possible.

In order to prevent liquid from the cutting chain leaving the chain sprocket chamber downwards, the chain sprocket chamber is largely closed in the area below the cutting chain in the usual set-down position in the direction of action of gravity. The outlet opening is thus positioned on the side of the chain sprocket facing away from the tip or nose of the guide bar. During operation the outlet opening is positioned on the side of the chain sprocket chamber facing downwards and towards the operator.

BRIEF DESCRIPTION OF THE DRAWINGS

Embodiments of the invention are explained below with reference to the drawings.

DESCRIPTION OF PREFERRED EMBODIMENTS

Figure 1:
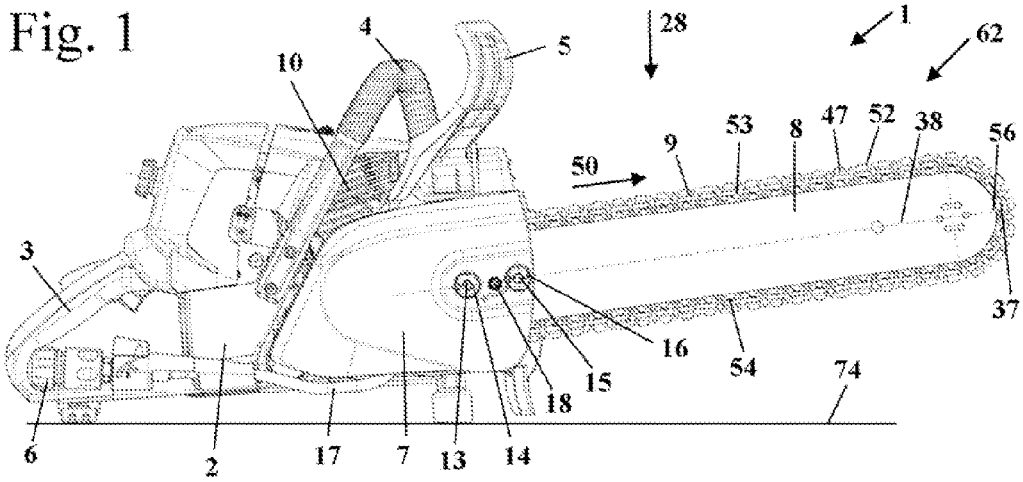
FIG. 1 shows a side view of a hand-operated implement.

FIG. 1 shows a hand-operated implement, namely a stone cutter 1. The stone cutter 1 is used for cutting mineral materials such as stone and concrete, for example. Metal materials such as reinforcing rods in concrete, for example, can also be cut by the stone cutter 1. In such cases the metal material is advantageously embedded in the mineral material. FIG. 1 shows the stone cutter 1 in the usual set-down position 62 on a flat supporting surface 74. FIG. 1 also shows the direction of action 28 of gravity when the stone cutter 1 is in the usual set-down position 62. The stone cutter 1 has a housing 2 to which are fixed a rear handle 3 and a handlebar 4 for guiding the stone cutter 1. Fixed to the housing 2 is a guide bar 8 around which a cutting chain 9 is fitted. The cutting chain is driven around the guide bar 8 in a direction of travel 50 by a drive motor 10 positioned in the housing 2. In the embodiment the drive motor 10 takes the form of an internal combustion engine, in particular a two-stroke single cylinder engine. The rear handle 3 and the handlebar 4 are insulated from internal combustion engine 10 in such a way as to reduce the transmission of vibrations. A hand guard 5 positioned on the side of the handlebar 4 facing the cutting chain 9 is fixed to the housing 2. At the end projecting forward from the housing 2 the guide bar 8 has a nose 56 around which a cutting chain 9 turns.

Fixed to the housing 2 is a chain sprocket cover 7 which overlaps the end of the guide bar 8 adjacent to the housing 2. Fixed to the housing 2 are two fixing bolts 13 and 15 to which are screwed the fixing nuts 14 and 16 positioned on the chain sprocket cover 7. The guide bar 8 and the chain sprocket cover 7 are held onto the housing 2 by the fixing nuts 14 and 16. The fixing nuts 14 and 16 can be held captively on the chain sprocket cover 7. An adjusting screw 18 is provided in an area between the two fixing nuts 14 and 16. The adjusting screw 18 serves to adjust a chain tensioning device. The stone cutter 1 has a water pipe 17 which has to be connected to a water supply by means of a water connection 6 for the supply of liquid, in particular water.

Figure 2:
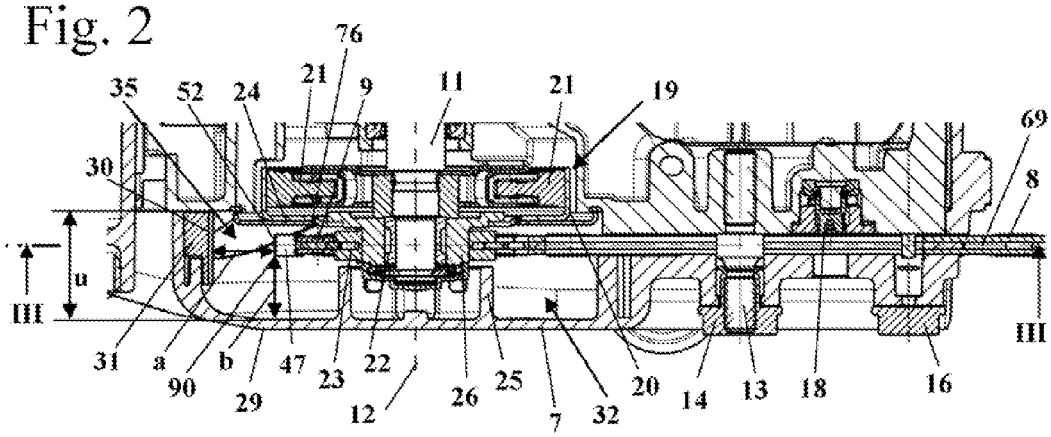
FIG. 2 shows a section though a section of the implement n the area f the chain sprocket cover along the line II-II indicated in FIG. 3.

The drive motor 10 drives a drive shaft 11 which is shown in FIG. 2. If the drive motor 10 is an internal combustion engine, the drive shaft 11 is advantageously the crankshaft of the internal combustion engine. Arranged on the drive shaft 11 is a centrifugal clutch 19 which has several radially mobile fly weights 21. In the retracted position shown in FIG. 2, the fly weights 21 come into contact with a clutch drum 20 and connect the clutch drum 20 to the drive shaft 11 such that it is unable to rotate. Fixed to the clutch drum 20 is a pinion 26. At the pinion 26 the clutch drum 20 is mounted on the drive shaft such that it is able to rotate by means of a bearing 22 which is advantageously a needle bearing. Arranged on the pinion 26 is a chain sprocket 23 which is connected to the pinion 26 such that it is unable to rotate. The pinion 26 itself can also be configured as a chain sprocket which drives the cutting chain 9. As shown in FIG. 2, the area of the centrifugal clutch 19 is covered by a cover plate 24 which prevents water and dirt from the chain sprocket chamber 32 from penetrating the centrifugal clutch 19.

Figure 18:
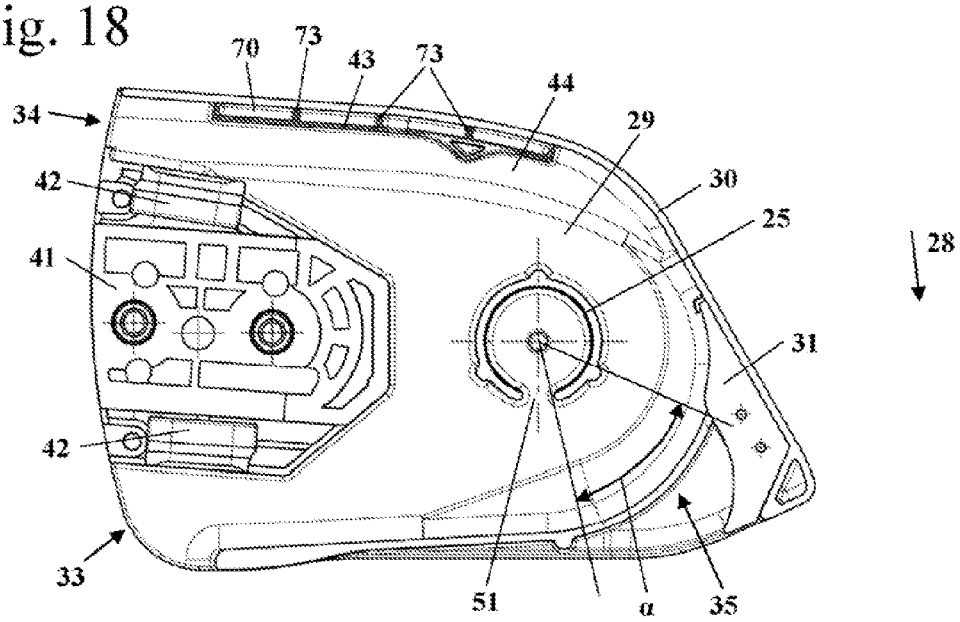
FIG. 18 shows a side view of the chain sprocket cover in the direction of he arrow XVIII illustrated in FIG. 13.
Figure 19:
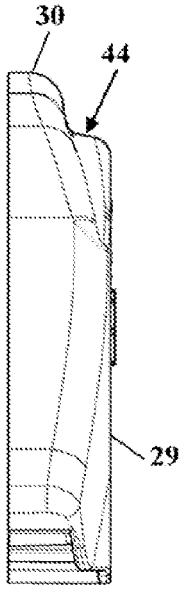
FIG. 19 shows a side view of the chain sprocket over in the direction of he arrow XIX illustrated in FIG. 12.

As also shown in FIG. 2, the chain sprocket cover 7 has a web 25 which, as shown in FIG. 18, is approximately circular in shape and the end face of which projects towards the chain sprocket 21. In this arrangement, the web 25 is located a short distance from the chain sprocket 23. The web 25 ensures that the chain sprocket 23 cannot slip off the pinion 26.

As shown in FIG. 1, the cutting chain 10 has cutting elements 47. Each cutting element has a top 52 on the side facing away from the guide bar 8. The top 52 is the area of the cutting elements 47 which comes into contact with and removes material from the workpiece.

As shown in FIG. 2, the chain sprocket cover 7 delimits a chain sprocket chamber 32 in which are arranged the chain sprocket 23, part of the cutting chain 9 and part of the guide bar 8. The chain sprocket cover 7 has a sidewall 29 which runs at an angle and particular perpendicular to an axis of rotation 12 of the chain sprocket 23. The axis of rotation 12 of the chain sprocket 23 is the same as the axis of rotation of the drive shaft 11. The chain sprocket cover 7 also has a peripheral wall 30 which in the embodiment is aligned approximately parallel to the axis of rotation 12 of the chain sprocket 23 and delimits the side of the chain sprocket chamber 32 facing the top 52 of the cutting elements 47.

Figure 5:
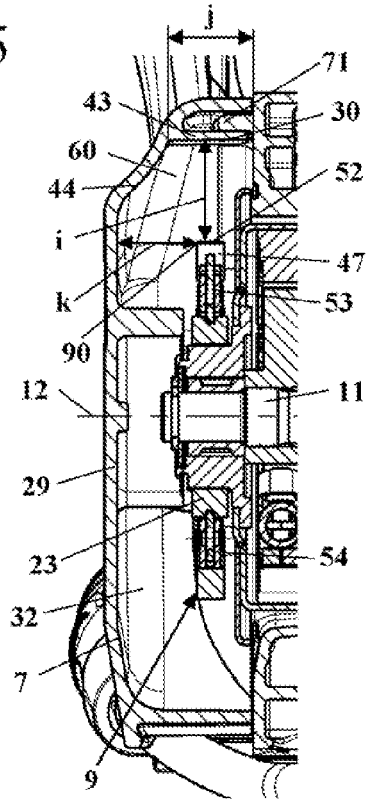
FIG. 5 shows a section of a section through the implement along the line V-V indicated in FIG. 3.

As shown in FIG. 2, in the sectional plane shown in FIG. 2 the top 52 is located a distance a from the peripheral wall 30. Distance a is less than approximately 3 cm and in particular less than approximately 2.5 cm. In the embodiment distance a is approximately 1.5 cm to 2 cm. On the side facing the sidewall 29 the top 52 of the cutting elements 47 has a longitudinal edge 90 which is also shown in FIG. 5. In the sectional plane shown in FIG. 2, the longitudinal edge 90 is located a lateral distance b from the sidewall 29 measured parallel to the axis of rotation 12 which is approx. 1.5 to approximately 2 cm. The chain sprocket chamber 32 has a maximum width u measured parallel to the axis of rotation 12 which is approximately 2.5 to approximately 3 cm.

Figure 3:
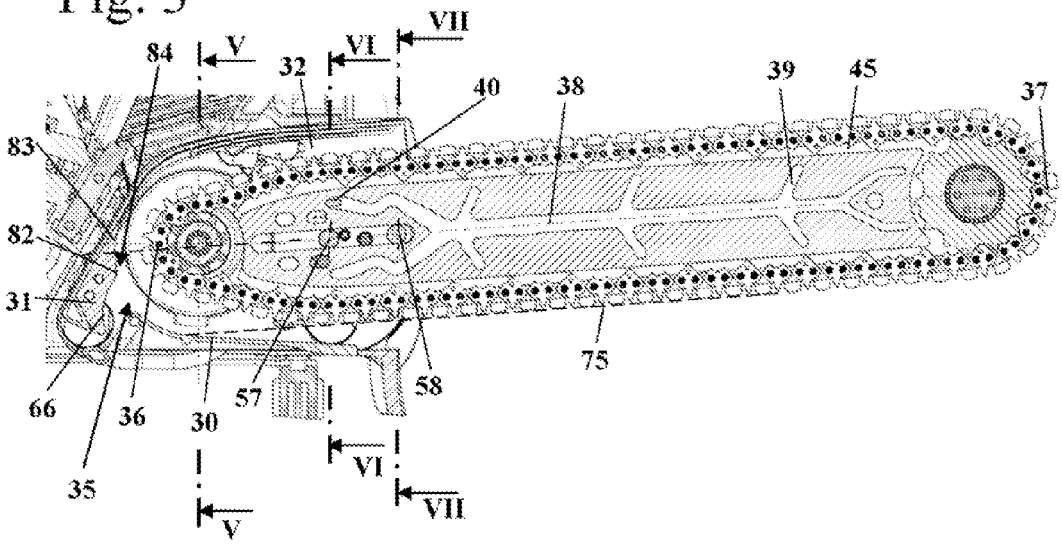
FIG. 3 shows a section through the implement along the line III-Ill indicated in FIG. 2.
Figure 4:
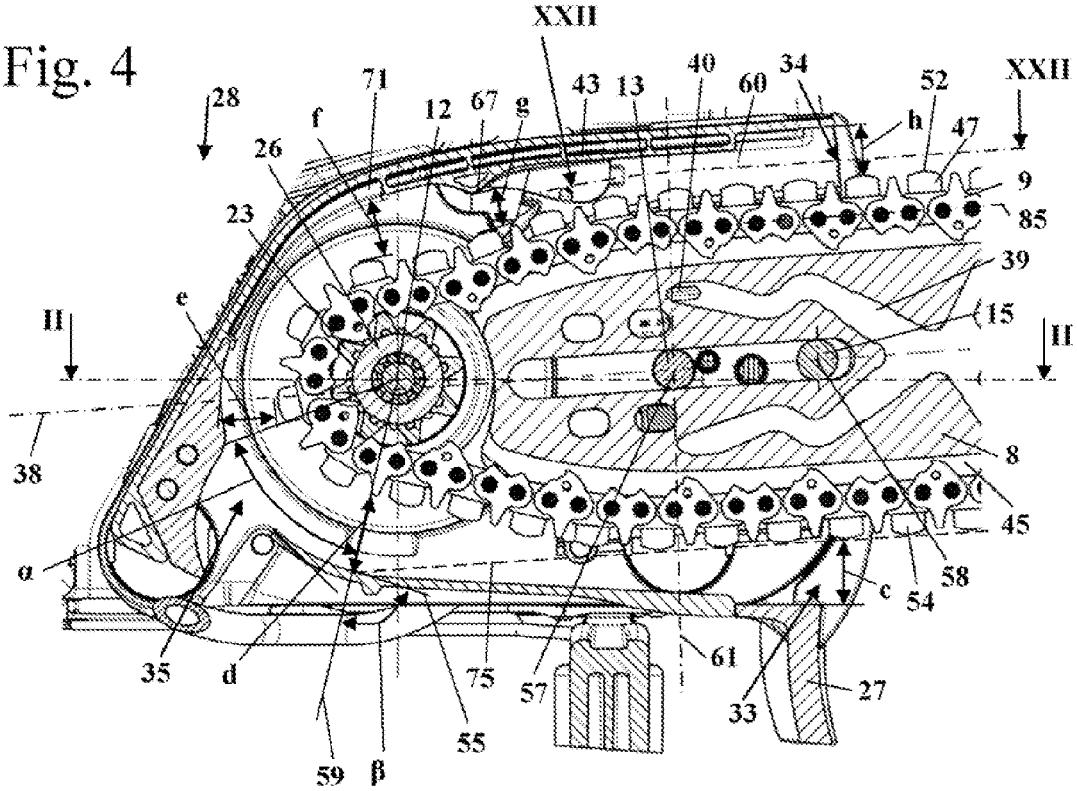
FIG. 4 shows an enlarged view of the area of the chain sprocket cover from the sectional drawing in FIG. 3.

The guide bar 8 has a longitudinal central axis 38 shown in FIGS. 1, 3 and 4 which bisects a central axis 57 of the fixing bolt 13 and a central axis 58 of the fixing bolt 15. The longitudinal central axis 38 bisects the cutting chain 9 adjacent to the chain sprocket 23 in a first turning area 36 shown in FIG. 3. Adjacent to the nose 56 of the guide bar 8, the longitudinal central axis 38 bisects the cutting chain 9 in a second turning area 37. A shown in FIG. 1, the cutting chain 9 moves from the first turning area 36 to a second turning area 37 in the direction of travel 50. In the usual set-down position the cutting chain 9 is positioned on the top of the guide bar 8 in the first section 53. From the second turning area 37 the cutting chain 9 moves in a second section 54 towards the first turning area 36. The guide bar 8 has a notional plane 69 shown in FIG. 2 which contains the longitudinal central axis 38 and runs centrally between the lateral faces of the guide bar 8.

In the sectional plane shown in FIG. 2, the peripheral wall 30 is configured on a guide part 31 of the chain sprocket cover 7. Configured in the peripheral wall 30 is an outlet opening 35 from which mud formed of supplied water and stone or metal dust is able to leave the chain sprocket chamber 32. As shown in FIG. 2, the outlet opening 35 extends over only part of the width u of the chain sprocket chamber 32. The guide part 31 delimits the outlet opening 35 on the side positioned behind the outlet opening 35 in the direction of travel. During operation the abrasive mud carried along by the cutting chain 9 is sprayed against the guide part 31. The guide part 31 is advantageously solid in design and is made of a wear-resistant material such as an elastomer or rubber in order to minimise the wear caused by the mud sprayed against the guide part. As shown in FIG. 3, configured on the guide part 31 is a guide surface 66 which guides the mud out of the chain sprocket chamber 32 and in the usual working position downwards towards the ground. The guide surface 66 runs slightly concavely in a curve. In this arrangement the guide surface 66 curves downwards and forwards, i.e. towards the guide bar and away from the operator. This prevents mud for escaping at the rear towards the operator. The guide part 31 also has a guide surface 83 which in the usual set-down position is positioned above the guide surface 66. The guide surface 83 forms part of the peripheral wall of the chain sprocket cover 8 and delimits the guide chamber 60 (FIG. 5) between the peripheral wall 30 and the top 52 of the cutting chain 9. Configured between the two guide surfaces 66 and 83 is a separating edge 84 which separates the mud to be returned to the outlet opening 35 from the mud to be guided to the cutting chain 9.

The outlet opening 35 opens at a start 76 for front end) shown in FIG. 2 positioned at the front in the direction of travel 50. The start 76 of the outlet opening 35 lies in a notional plane 75 shown in FIG. 3 in which the tops 52 of the cutting elements 47 in the second section 54 of the cutting chain 9 before it enters the chain sprocket chamber 32 also lie. The outlet opening 35 thus starts in an extension of the outer side of the cutting chain 9 in the second section 54. Mud carried along by the cutting chain enters the chain sprocket chamber 32 in this direction. This configuration of the start 76 of the outlet opening minimises contact between the mud to be removed from the chain sprocket chamber 32 and the peripheral wall 30 and thus reduces wear at the chain sprocket cover 7. The outlet opening 35 has a rear end 82 in the direction of travel 50 which is delimited by the separating edge 84 of the guide part 31. As shown in FIG. 2, the outlet opening 35 opens gradually from the start 56 to the end 82 which lies behind it in the direction of travel 50, the sidewall advantageously running in a straight line or curve angled to the direction of travel 50.

FIG. 4 shows the distances between the tops 52 of the cutting elements 47 and the peripheral wall 30 measured in the plane 69 of the guide bar 8 in different areas of the chain sprocket chamber 32. The cutting chain 9 enters the chain sprocket chamber 32 at an entry opening 33 positioned in the second section 54. At the entry opening 33 the top 52 is located a distance c from the peripheral wall 30 of the chain sprocket chamber 32. As shown in FIG. 3, the peripheral wall 30 is formed adjacent to the entry opening 33 on a guard 27 which can be made of an elastic material, for example. Distance c is advantageously approximately 1.5 to approximately 2 cm. Distance c is advantageously as large as possible so that as much as possible of the water or mud carried along by the cutting chain is collected and enters the chain sprocket chamber 32. In this arrangement the entry opening 33 extends across the whole width u of the chain sprocket chamber 32. At the entry opening 33 the peripheral wall 30 is advantageously located distance c from the top (52), which is at least 1.5 cm, across the whole width u.

As shown in FIGS. 2 and 4 the outlet opening 35 is positioned in an area essentially adjacent to the cutting chain 9 in the usual set-down position seen in the direction of action 28 of gravity shown in FIG. 1. In this arrangement the outlet opening 35 is positioned on the side facing away from the tip or nose 56 of the guide bar 8 and essentially behind the cutting chain 9 in the direction of travel 50 of the second section 54 of the cutting chain 9. When the stone cutter 1 is oriented such that the guide bar 8 is pointing forwards, the outlet opening 35 is positioned essentially behind the chain sprocket 23 and the section of the cutting chain 9 running around the chain sprocket 23. The outlet opening 35 extends over a circumferential angle α shown in FIG. 4 about the axis of rotation 12 which is less than 90°. The angle α is advantageously up to approximately 60°. Before the start 76 of the outlet opening 35 seen in the direction of travel 50, the peripheral wall 30 forms a guide section 55. This guide section 55 is configured so as to guide liquid which sprays or drips off the cutting chain 9 such as water, for example, past the outlet opening 35 so that it can be returned to the cutting chain 9. Due to the outlet opening 35 most of the mud sprayed along the plane 75 into the chain sprocket chamber 32 is carried away. The guide section 55 runs directly adjacent to the outlet opening 35 at an angle β to a radial 59 to the axis of rotation 12 which is advantageously more than approximately 70°. The guide section 55 advantageously runs approximately perpendicular to the radial 59. The guide section 55 thus runs approximately parallel to the direction of movement of the top 52 of the cutting elements 47 in the adjacent area of the cutting chain 9. The peripheral wall 30 which delimits the outlet opening 35 runs approximately parallel to the length of the adjacent section of the cutting chain 9 and continues the guide section 55.

At the longitudinal central axis 38 of the guide bar 8 the top 52 of a cutting element 47 is located a distance e from the peripheral wall 30. Distance e is approximately 1.0 cm to approx. 2.5 cm. Before the outlet opening 35 in the direction of travel 50 distance d from the top 52 of a cutting element 47 to the peripheral wall 30 is greater. Distance d before the outlet opening 35 is approximately 1.5 cm to approximately 3.0 cm. In this arrangement distance d is advantageously greater than distance 2.

As shown in FIG. 4, the pinion 26 is connected via splined toothing to the chain sprocket 23 such that it is unable to rotate. Due to the splined toothing, once the chain sprocket cover 7 has been removed the chain sprocket 23 can be removed from the pinion easily for cleaning or replacement. Positioned on the peripheral wall 30 adjacent to the first section 53 of the cutting chain 9 is an additional wall 43 which forms the peripheral wall 30 and which requires a reduced distance between the peripheral wall 30 and the top 53 of the cutting element 47. Immediately before the additional wall 43 in the direction of travel 50 the top 52 is located a distance f from the peripheral wall 30 which may be approximately 1.5 cm to approximately 2.5 cm, for example. A narrowed area 67 is formed adjacent to the entry of the cutting chain 9 into a guide groove 45 in the guide bar 8. At this narrowed area 67 the top 52 of the cutting elements 47 is located a distance g from the peripheral wall 30. In this arrangement the peripheral wall 30 is configured on the additional wall 43. Distance g is advantageously approximately 0.8 cm to approximately 1.5 cm. The cutting chain 9 exits the chain sprocket chamber 32 at an exit opening 34. At the exit opening 34 the distance h between the top 52 of the cutting elements 47 and the peripheral wall 30 is approximately 1 cm to approximately 1.5 cm. The peripheral wall 30 advantageously runs evenly, the distances f, g, h to the top 52 of the cutting chain 9 advantageously being largely constant. The peripheral wall 30 advantageously has no edges, steps or projections which could create a nozzle effect. Configured between the top 52 of the cutting elements 47 and the peripheral wall 30 in the first section 52 (FIG. 1) of the cutting chain 9 is a guide chamber 60 which is described in greater detail below. The liquid is advantageously guided through the guide chamber 60 evenly and without nozzle effect, i.e. without dispersing the jet of liquid, and guided towards the cutting chain 9. During this process the mud is returned to the cut in a targeted manner.

Figure 6:
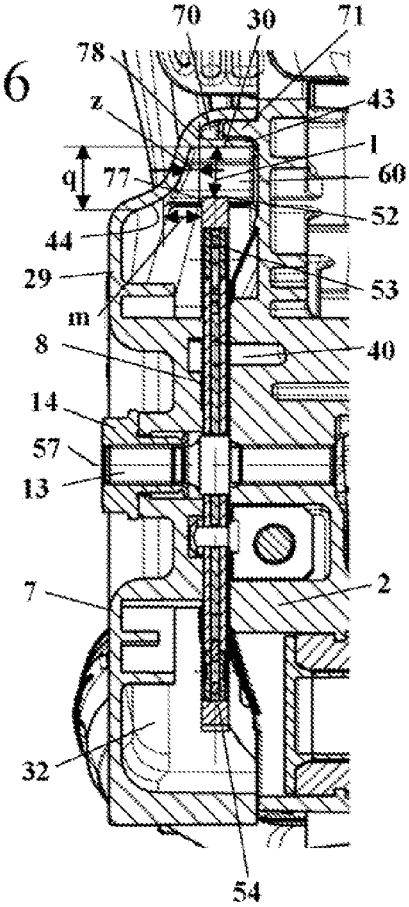
FIG. 6 shows a section of a section through the implement along the line VI-VI indicated in FIG. 3.
Figure 7:
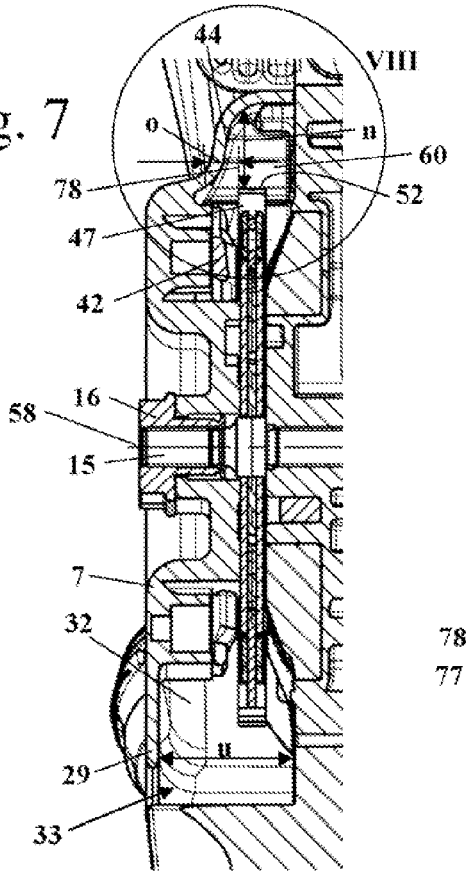
FIG. 7 shows a section of a section through the implement along the line VII-VII indicated in FIG. 3

FIGS. 5 to 7 show sections through the chain sprocket chamber 32 in different sectional plains indicated in FIG. 3. FIG. 5 shows a section through the chain sprocket chamber 32 in a sectional plane which contains the drive shaft 11. In the sectional plane shown in FIG. 5 the longitudinal edge 90 of the cutting elements 47 is located a lateral distance k measured parallel to the axis of rotation 12 from the sidewall 29 of approximately 1.5 cm to approximately 2 cm. The top 52 is located a distance i measured in the plane of the guide bar 8 and perpendicular to the axis of rotation 12 from the peripheral wall 30 which is approximately 1.7 cm to approximately 2.3 cm. The guide chamber 60 is configured between the top 52 and the peripheral wall 30. As shown in FIG. 5, the guide chamber 60 is delimited by a step 44 configured on the sidewall 29 of the chain sprocket cover 7. As also shown in FIG. 4, the peripheral wall 30 has a width j in a sectional plane shown in FIG. 5 which is approximately 1.7 cm to approximately 2.2 cm. The width j is thus approximately the same size as the distance k between the longitudinal edge 90 and the sidewall 29.

FIG. 6 shows a section through the chain sprocket chamber 32 in a second notional plane 61 shown in FIG. 4 which is perpendicular to the longitudinal central axis 38 and contains the central axis 57 of the fixing bolt 13. As shown in FIG. 6, the guide chamber 60 is clearly smaller in the plane 61 than in the sectional plane shown in FIG. 5. The step 44 extends laterally from the peripheral wall to the level of the cutting element 47. The lower edge of the step 44 facing the fixing bolt 13 is thus a greater distance from the peripheral wall 30 than the top 52 of the cutting element 47. Distance m between the longitudinal edge 50 (FIG. 5) and the sidewall 29 is measured to the step 44. Distance m is advantageously approximately 0.4 cm to approximately 0.8 cm. The top 52 is located a distance I, which is advantageously approximately 1 cm to approximately 1.5 cm, from the peripheral wall 30 which is also configured in the second plane 61 on the additional wall 42. The cutting element 47 has an outer side 77 facing the sidewall 29 which lies in the first notional plane 78. The first notional plane 78 runs parallel to the plane of the guide bar 8. In the centre between the peripheral wall 30 and the top 52 the first notional plane 78 is located a distance z from the sidewall 29 which is smaller than the distance m. The distance z is advantageously approximately 0.2 cm to approximately 0.7 cm and in particular less than approximately 0.5 cm. The guide chamber 60 is clearly smaller in the sectional plane shown in FIG. 6 than in the sectional plane shown in FIG. 6.

FIG. 6 also shows a water inlet opening 40 which is configured on the housing 2. The water inlet opening 40 is also shown in FIG. 3. As shown in FIG. 3, the water inlet opening 40 flows leads into a water channel 39 configured in the guide bar 8. The water channel 39 branches through the guide bar 8 and cools the guide bar 8 and conveys water into the guide groove 45 via outlet openings (not shown).

As also shown in FIG. 6, at the inner contour of the chain sprocket cover 7 the step 44 has a height q measured perpendicular to the central axis 57 of the fixing bolt 13 and parallel to the first notional plane 78 which is approximately 1 cm to approximately 2 cm. In the embodiment the height q is somewhat larger than the distance l.

As also shown in FIGS. 5 and 6, the chain sprocket cover 7 is situated adjacent to the second section 54 of the cutting chain 9 on the housing 2 of the stone cutter 1. The closed chain sprocket chamber 32 is situated adjacent to the first section 53 of the cutting chain 9. The free cross-section of the guide chamber 60 advantageously narrows essentially continuously from the entry opening 33 to the exit opening 34. This increases the pressure of the mud carried along by the cutting chain 9 and deposited in the chain sprocket chamber 32 from the entry opening 33 to the exit opening 34. Before the exit opening 34 in the direction of travel 50 the housing 2 has a rib 71 (also shown in FIG. 9) which projects into the pocket 70 in the chain sprocket cover 7. The pocket 70 is formed between the additional wall 43 and an inner wall of the chain sprocket cover 7. The additional wall 43 and the rib 71 abut one another. In the area of the additional wall 43 and the rib 71, the housing 2 and the chain sprocket cover 7 form a labyrinth seal to seal the chain sprocket chamber 32. The seal formed by the additional wall 43 and the rib 71 prevents liquid from escaping in this area in which the liquid is under high pressure. In this arrangement the rib 71 extends as far as possible towards the exit opening 34. A seal for the chain sprocket chamber 32 between the chain sprocket cover 7 and the housing 2 can also be provided adjacent to the second section 54 of the cutting chain 9.

FIG. 7 shows a section through the chain sprocket chamber 32 in a sectional plane containing the central axis 58 of the second fixing bolt 15. This sectional plane is directly adjacent to the entry opening 33 and to the exit opening 34. As shown in FIG. 7, the guide chamber 60 is narrower than in the sectional plane in FIG. 6. The longitudinal edge 90 of the cutting element 47 is located a distance o from the sidewall 29 measured parallel to the central axis 58 and thus also parallel to the axis of rotation 12. In this arrangement distance o is measured at the level of the step 44. Distance o is advantageously approximately 0.4 cm to approximately 0.8 cm. The top 52 is located a distance n from the peripheral wall 30 which is advantageously approximately 1.5 cm to approximately 2 cm. A smaller distance n can also be advantageous. Distance n is greater in the sectional plane shown in FIG. 7 than in the sectional plane shown in FIG. 6 since there is no provision for an additional wall 43 in FIG. 7. FIG. 7 also shows the width u of the chain sprocket chamber 32.

Adjacent to the exit opening 34 (FIG. 4) the guide chamber 60 has a height x (shown in FIG. 8) which is advantageously approximately 1.5 cm to approximately 2 cm. The height x is approximately the same as the height of the step 44. Halfway along height x, i.e. at a distance r from the peripheral wall 30 corresponding to half the height x, the guide chamber 60 has a mean width s which is advantageously approximately 1 cm to approximately 1.5 cm. At distance r from the peripheral wall 30 the first notional plane 78 containing the sidewall 77 of the cutting element 47 is located a distance t measured parallel to the central axis 58 from the sidewall 29 which is less than 0.8 cm and in particular approximately 0.1 cm to 0.5 cm. The width v of the cutting element 47 at the top 52 is advantageously approximately 0.4 cm to 0.7 cm. The cutting element 47 has an inner wall 81 facing the housing 2 which lies in a fourth notional plane 89. At distance r from the peripheral wall 30 the fourth notional plane 89 is located a distance 86 measured perpendicular to the fourth notional plane 89 from the housing 2. The distance 86 is advantageously approximately the same as the distance t resulting in an approximately central arrangement of the cutting element 47 in the exit opening 34. The distance 86 is advantageously as small as possible. In the area between the second notional plane 61 and the exit opening 34 the distance 86 is advantageously approximately the same as distance t in each sectional plane running parallel to the second notional plane 61. During operation the cutting element 47 is thus positioned centrally between the sidewall 29 and the housing 2 from the second notional plane 61 to the exit opening 34.

Figure 9:
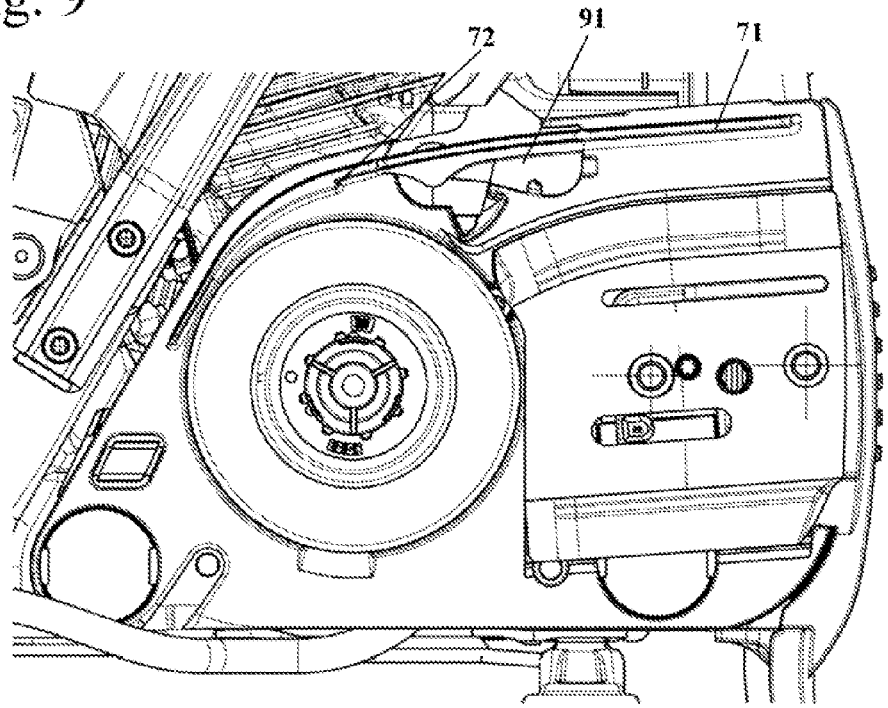
FIG. 9 shows a side view of a section of the implement illustrated in FIG. 1 with the chain sprocket cover removed.
Figure 10:
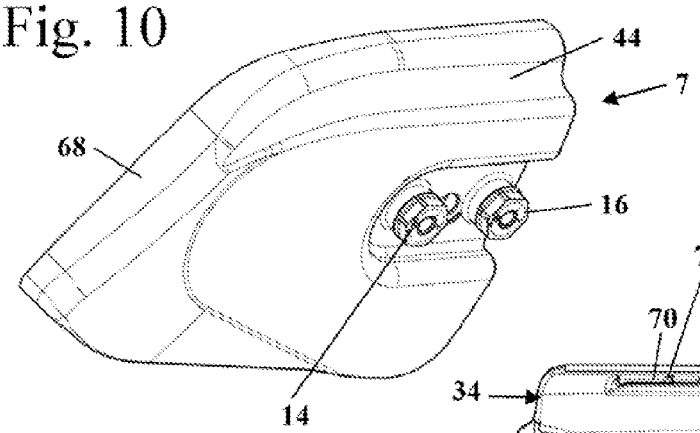
FIG. 10 a perspective views of the chain sprocket cover of the implement.

FIG. 9 shows the course of the rib 71. A central section of the rib 73 is formed on a cover 91 fixed to the housing 2 which is advantageously made of rubber or an elastomer. The cover 91 can serve to cover a fixing for the hand guard 5 of the stone cutter 1 and/or to provide an elastic mount for the hand guard 5. As shown in FIG. 9 in conjunction with FIG. 4, the area of the rib 71 located before the additional wall 43 in the direction of travel (FIG. 1) is widened. Immediately adjacent to the front side of the additional wall 43 in the direction of travel 50 the rib 71 has a projection 72 at which the width of the rip 71 narrows. As shown in FIG. 4, the section of the peripheral wall 30 formed at the rib 71 becomes the section of the peripheral wall 30 formed on the additional wall 43. This ensures that the peripheral wall 30 has a constant course without projections of jumps.

Figure 13:
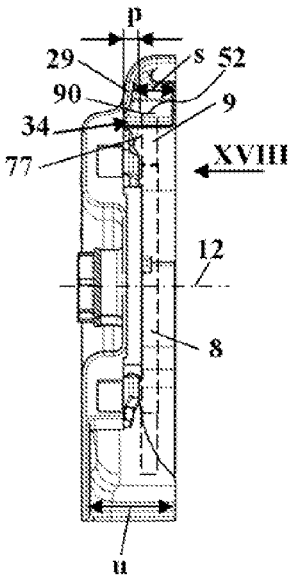
FIG. 13 shows a view of the chain sprocket cover in the direction of the arrow XIII illustrated in FIG. 12.

FIGS. 10 to 19 show the chain sprocket cover 7 in detail. As shown in FIG. 13, the sidewall 29 at the exit opening 34 is located a distance p, which is advantageously less than approximately 0.8 cm, from the longitudinal edge 90 of the cutting chain shown schematically in FIG. 13. Distance p is advantageously approximately 0.1 cm to approximately 0.5 cm. Distance p is advantageously matched to the width v of the top 52 of the cutting elements 47 shown in FIG. 8. Distance p is advantageously between approximately 80% and approximately 120% of the width v of the top 52 of the cutting element 47. Width v is advantageously approximately 0.4 cm to approximately 0.8 cm. In the embodiment width v is approximately 0.55 cm.

Figure 11:
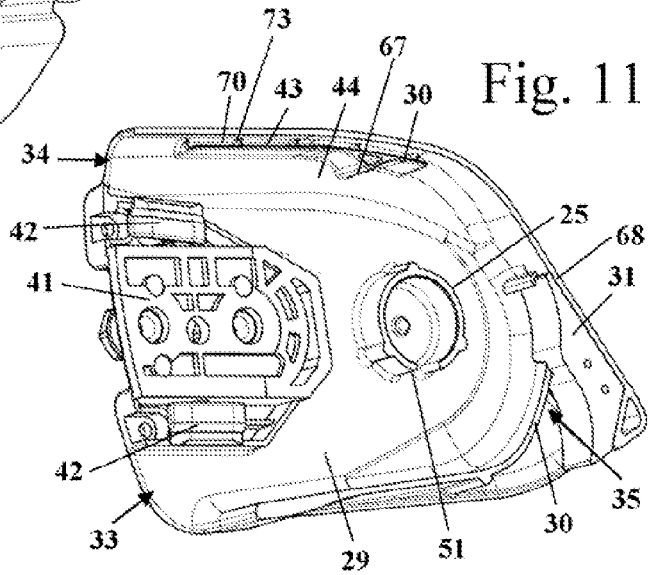
FIG. 11 shows another perspective views of the chain sprocket cover of the implement.
Figure 12:
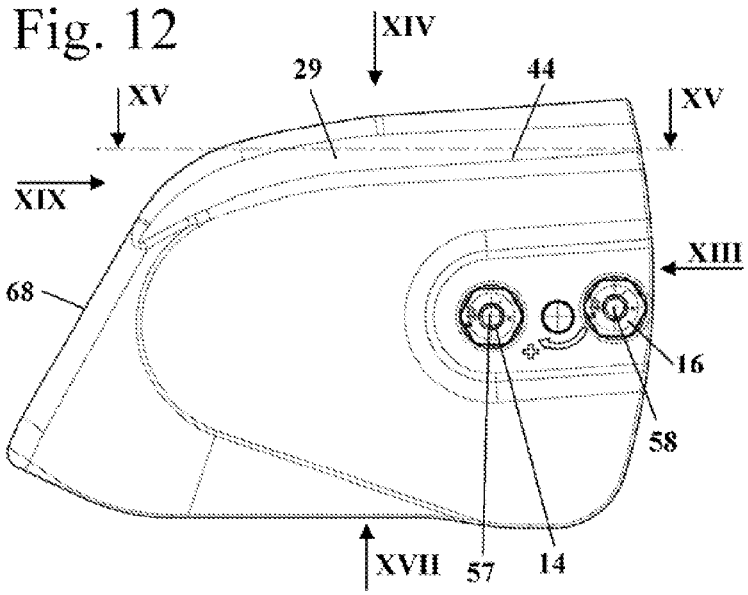
FIG. 12 shows a side view of the chain sprocket cover.
Figure 14:
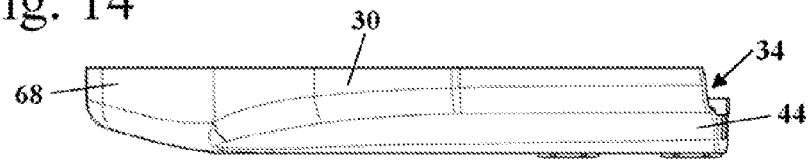
FIG. 14 shows a top view of the chain sprocket cover in the direction of the arrow XIV illustrated FIG. 12.

FIGS. 10 to 16 and 18 show the course of the step 44 in detail. The step 44 extends from a rear wall 68 of the chain sprocket cover 7 to the exit opening 34. In this arrangement the step 44 is a possible advantageous embodiment of the boundary wall of a guide chamber 60 of reduced width. Other designs may also be advantageous. As shown in FIG. 14 in particular, in this arrangement the step 44 widens out from the rear wall 68 to the exit opening 34. In this arrangement the rear wall 68 is the closed side of the chain sprocket cover 7 facing away from the entry opening 33 and the exit opening 34. As shown in FIG. 11, the elastic guide part 31 is fixed at the rear wall 68. Arranged on the chain sprocket cover 7 is the contact surface 41 for the guide bar 8 shown in FIGS. 11 and 18. When fitted, the fixing bolts 13 and 15 (FIGS. 6 and 7) pass through the contact surface 41. As shown in FIGS. 11 and 18, located on the underside of the web 25 in the direction of action 28 of gravity in the usual set-down position 62 shown in FIG. 1 is a recess 51 through which liquid or dirt which has collected inside the web 25 can run away downwards. In FIG. 18 the chain sprocket cover 7 is angled slightly in relation to the usual set-down position 62 such that in the view given in FIG. 18 the direction of action 28 of gravity runs downwards at a slight angle rather than straight downwards. The peripheral wall 30 is oriented adjacent to the second section 54 of the cutting chain such that when the guide bar is horizontal, i.e. in the usual position of the stone cutter 1 when cutting, the peripheral wall 30 slopes down forwards towards the tip or nose 56 of the guide bar 8. This causes liquid to run out of the chain sprocket chamber 32 downwards and forwards, past the outlet opening 35 to the peripheral wall 30. In the usual set-down position 62 the area of the peripheral wall 30 adjacent to the second section 54 of the cutting chain 9 is angled to the rear, i.e. towards the outlet opening 35 so that liquid is guided down from the peripheral wall 30 to the outlet opening and runs out of the chain sprocket chamber 32 through the outlet opening 35.

Figure 15:
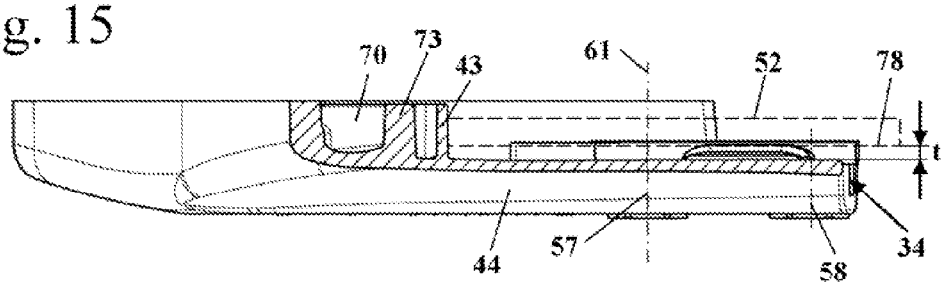
FIG. 15 shows a section along the line XV-XV indicated in FIG. 12.

As shown in FIGS. 11 to 18, slide strips 42 are positioned on the chain sprocket cover 7 adjacent to the entry opening 33 and the exit opening 34 to guide the cutting chain 9 laterally. FIGS. 11 and 15 show webs 73 which connect the additional wall 43 to the peripheral wall 30 of the chain sprocket cover 7.

Figure 17:
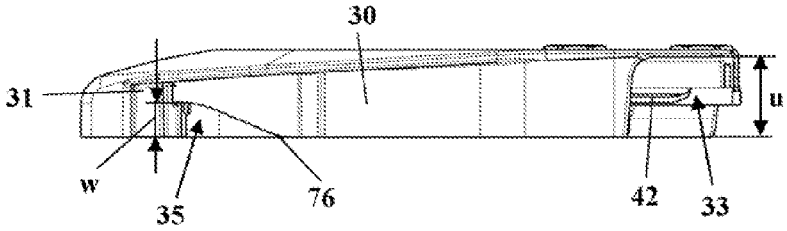
FIG. 17 shows a view of the chain sprocket cover from below in the direction of the arrow XVII illustrated in FIG. 12.

A shown in FIGS. 11 and 17 in particular, the outlet opening 35 is formed by an approximately triangular recess in the peripheral wall 30. The greatest width w of the outlet opening 35, which is formed in the rear area of the outlet opening 35 in relation to the direction of travel 50 (FIG. 1), is advantageously less than two thirds and in particular less than half of the width u of the chain sprocket chamber 32 shown in FIG. 13. At the start 76, which is located at the front in the direction of travel 50, the sidewall of the outlet opening 35 makes the transition to the contact surface of the chain sprocket cover 7 at the housing 2 at an acute angle. FIG. 18 also shows the angle $\alpha$ over which the outlet opening 35 extends. The outlet opening 35 opens gradually in the direction of travel 50. The outlet opening 35 does not open to the full width u of the chain sprocket chamber 32 at any point, rather it opens to only part of the full width u. This reduces the amount of mud leaving the chain sprocket chamber 32 and thus water consumption.

As also shown in FIGS. 11, 13 and 17, the peripheral wall 30 largely seals he chain sprocket chamber 32. The chain sprocket chamber 32 is open to the environment at the entry opening 33, the exit opening 34 and the outlet opening 35 only.

Figure 20:
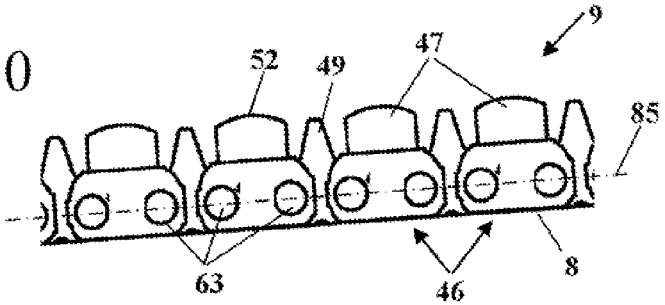
FIG. 20 shows a side view of a section of the cutting chain of the implement fitted on the guide bar.
Figure 21:
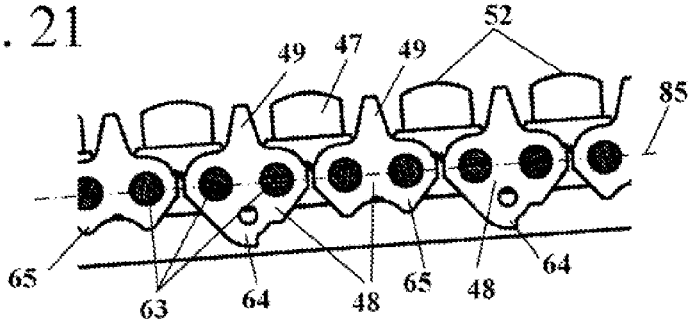
FIG. 21 shows a longitudinal section through the cutting chain of the implement fitted on the guide bar.

The step 44 causes a lateral narrowing of the chain sprocket chamber 32 in the first section 53 of the cutting chain 9 (FIG. 1). The chain sprocket chamber 32 can also be narrow over its entire height. However, the broad design of the chain sprocket cover 7 in the area of the fixing nuts 14 and 16 shown has the advantage that the fixing nuts 14 and 16 do not project beyond the outer contour of the chain sprocket cover 7. The narrowing of the chain sprocket chamber 32 means that liquid, in particular water, collected in the chain sprocket chamber 32 is conveyed back to the cutting chain 9 is a targeted manner so that this water is once again available for cooling and for carrying away workpiece grit. In this arrangement the sidewall 29 runs straight along the step 44 along the longitudinal direction 85 of the cutting chain 9. In this arrangement the longitudinal direction 85 shown in FIGS. 4, 20 and 21 is the line connecting all the centre points of the connecting pins 63 of the cutting chain 9. As shown in FIG. 15, the sidewall 29 runs approximately parallel to the first notional plane 78 at a distance t from the first notional plane 78. In this arrangement the sidewall 29 runs constantly along in the longitudinal direction 85 of the cutting chain, i.e. without edges or jumps. The sidewall 29 is advantageously inclined at an angle of less than approximately 45° in relation to the longitudinal direction 85 of the cutting chain 9. Where the sidewall 29 is curved in the longitudinal direction 85 of the cutting chain 9, the angle of inclination to a tangent to the sidewall 29 is advantageously less than 45° at every point from the second notional plane 61 (FIG. 15) to the exit opening 34. In this arrangement the lateral distance between the cutting chain 9 and the sidewall advantageously decreases in the direction of travel 50 of the cutting chain 9.

Figure 22:
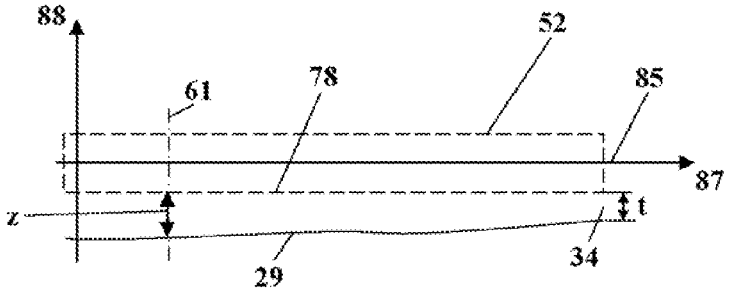
FIG. 22 shows a schematic view of the course of a sidewall of the chain sprocket chamber.

FIG. 22 shows a schematic view of a possible curved course of the sidewall 29. In this arrangement the course of the sidewall 29 is shown as a function in a coordinate system with an x-axis 87 and a y-axis 88. The course of the sidewall 29 is shown centrally between the tops 52 of the cutting elements 47 and the peripheral wall 30 along the sectional plane XXII-XXII indicated in FIG. 4. The sectional plane runs parallel to the axis of rotation of the chain sprocket 23 and centrally between the tops 52 of the cutting elements 47 and the peripheral wall 30. The tops 52 of the cutting elements 47, the first notional plane 78 and the second notional plane 61 are shown schematically in FIG. 22. As shown in FIG. 22, the course of the sidewall 29 is slightly curved. The derivative of the function describing the course of the sidewall 29, i.e. the incline of the curve shown, is less than 1 at every point from the second notional plane 61 to the exit opening 34. The sidewall advantageously runs from the first turning area 36 to the exit opening 34 with an incline which is less than 5 and in particular less than 1 in the aforementioned sectional plane. The distance z, t between the sidewall 29 and the first notional plane 78 over at least 30% of the section from the second notional plane 61 to the exit opening 34 is less than 0.8 cm. In particular, the distance z, t between the sidewall 29 and the first notional plane 78 over at least 50% and advantageously over at least 70/5 of the section between the first notional plane 61 and the exit opening 34 is less than 0.8 cm. Advantageously the distance is less than 0.8 cm at every point between the first notional plane 61 and the exit opening 34.

Figure 8:
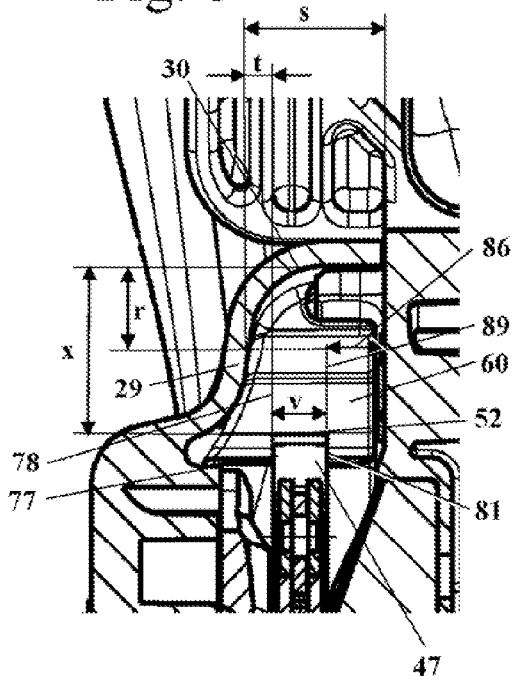
FIG. 8 shows an enlarged view of the section VIII indicated in FIG. 7.
Figure 16:
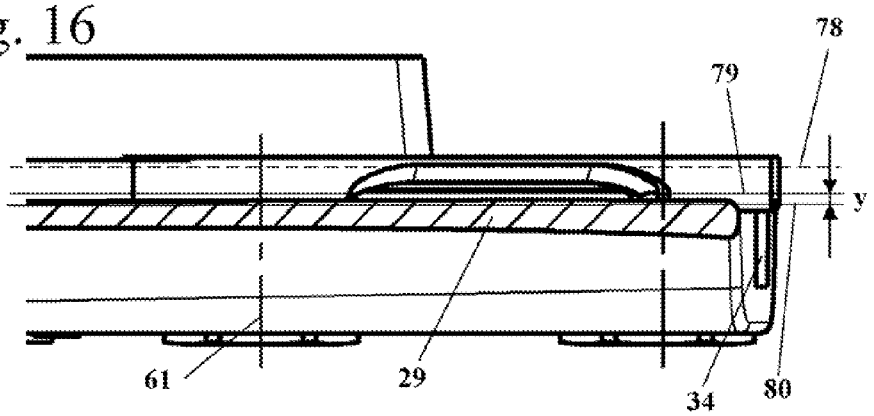
FIG. 16 shows an enlarged section from FIG. 15.

FIG. 16 shows the course of the sidewall 29 at approximately halfway between the top 52 of the cutting elements 47 and the peripheral wall 30. This half-way point is shown in FIG. 8. The distance from the sidewall 29 to the first notional plane 78 advantageously changes between the second notional plane 61 and the exit opening 34 by less than approximately 20% of the distance t between the plane 78 and the sidewall 29 as shown in FIG. 15. The sidewall 29 therefore runs from the notional plane 61 to the exit opening 34 in a region between two planes 79 and 80. In this arrangement the distance y between the planes 79 and 80 is 20% of the distance t. The planes 79 and 80 run parallel to one another and parallel to the plane of the guide bar 8. The sidewall 29 advantageously has no steps, projections, etc. at right angles to the longitudinal direction 85 of the cutting chain 9 so as not to impair the conveyance of water to the cutting chain 9. Necessary transitions in the sidewall 29 of the chain sprocket cover 7 are advantageously smooth, not abrupt. The sidewall 29 advantageously has a soft, curved or straight course from the first turning area 36 (FIG. 3) to the exit opening 34 (FIG. 3).

The mean width s of the guide chamber 60 adjacent to the exit opening 34 (FIG. 13) is advantageously less than approximately 70% of the greatest width u of the chain sprocket chamber 32. The step 44 narrows the chain sprocket chamber 32. At the step 44 the width s is no more than 70% and in particular no more than 50% of its maximum width. The lateral distance from the longitudinal edge 90 of the cutting elements 47 to the sidewall 29 between the notional plane shown in FIG. 2 and the exit opening 34 is advantageously less than approximately 1 cm and in particular less than approximately 0.8 cm. The distance z, t between the sidewall 29 and the first notional plane 78 measured halfway between the top 52 and the peripheral wall 30 is advantageously less than approximately 1 cm and in particular less than approximately 0.8 cm. The halfway height is measured the distance r shown in FIG. 8 from the peripheral wall 30. The distance r is the same as half the distance x between the peripheral wall 30 and the top 52 of the cutting chain 9. There is also advantageously a small gap to the peripheral wall between the first notional plane 61 and the exit opening 34. The distance from the top 52 to the peripheral wall 30 across the entire section from the entry opening 33 to the exit opening 34 with the exception of the outlet opening 35 is advantageously less than approximately 3 cm and in particular less than approximately 2.5 cm.

The design of the cutting chain 9 is shown in detail in FIGS. 20 and 21. The cutting chain 9 has cutting links 46 which are connected to one another by connecting pins 63 via drive links 48 in an articulated manner. In this arrangement the longitudinal direction 85 of the cutting chain 9 is the line connecting the centre points of all the connecting pins 63. In this arrangement drive links 48 and cutting links 46 alternate. Each cutting link 46 has a cutting element 47 with a top 52. Each drive link 48 has a projection 49 which extends in the area between consecutive cutting elements 47. The projection 49 is advantageously a somewhat smaller distance from the outside of the guide bar 8 than the tops 52 of the cutting elements. This prevents the cutting chain 9 from being pushed too close to the workpiece once the cutting element has engaged and the next cutting element 47 from being able to hit the workpiece. This ensures that the cutting chain 9 runs more quietly and reduces the vibrations occurring during operation, As shown in FIG. 21, drive links 48 with a drive tooth 64 and drive links 48 with a guide 65 are positioned alternately along the longitudinal direction 85 of the cutting chain 9. The guide 65 projects only slightly into the guide groove 45 and serves simply to support the cutting chain 9 laterally. The drive teeth 64 are entrained by the chain sprocket 23 (FIG. 4). The cutting chain 9 is driven by the drive teeth 64.

The specification incorporates by reference the entire disclosure of German priority document 10 2012 010 977.4 having a filing date of May 31, 2012.

While specific embodiments of the invention have been shown and described in detail to illustrate the inventive principles, it will be understood that the invention may be embodied otherwise without departing from such principles.

What is claimed is:

1. A hand-operated implement comprising:

a housing;

a drive motor arranged in the housing;

a guide bar fixed to the housing;

a cutting chain, fitted to the guide bar, for cutting mineral and metal materials;

the cutting chain comprising at least one cutting element which has a top facing away from the guide bar;

a chain sprocket chamber disposed at the housing;

a chain sprocket arranged in the chain sprocket chamber;

the cutting chain being driven around the guide bar in a direction of travel via the chain sprocket by the drive motor;

a device for feeding liquid to the cutting chain;

the guide bar having a longitudinal central axis bisecting the cutting chain adjacent to the chain sprocket in a first turning area and adjacent to the nose of the guide bar in a second turning area;

the cutting chain being driven in a first section from the first turning area to the second turning area in the direction of travel and in a second section from the second turning area to the first turning area in the direction of travel;

a chain sprocket cover connected to the chain sprocket chamber and having a sidewall that delimits the chain sprocket chamber;

the at least one cutting element having a top provided with a longitudinal edge, wherein the longitudinal edge faces the sidewall of the chain sprocket cover;

the chain sprocket chamber having an entry opening where the cutting chain enters the chain sprocket chamber and further having an exit opening where the cutting chain exits the chain sprocket chamber;

the chain sprocket chamber having a peripheral wall and at least one outlet opening formed at the peripheral wall;

the at least one cutting element having an outer side that is facing the sidewall and is positioned at least partially in a first notional plane;

a first fixing bolt securing the guide bar to the housing;

a second notional plane perpendicular to the longitudinal central axis of the guide bar, wherein a central axis of the first fixing bolt is positioned in the second notional plane;

a distance between the sidewall and the first notional plane, measured perpendicular to the first notional plane and centrally between the top of the at least one cutting element and the peripheral wall, is less than approximately 0.8 cm over at least 30% of the stretch extending between the second notional plane and the exit opening.

2. The implement according to claim 1, wherein said distance between the sidewall and the first notional plane measured at the exit opening is less than approximately 0.8 cm.

3. The implement according to claim 1, wherein said distance between the sidewall and the first notional plane is between approximately 80% and approximately 120% of a width of the top of the at least one cutting element.

4. The implement according to claim 1, wherein, in the first section from the second notional plane to the exit opening, said distance between the sidewall and the first notional plane, measured centrally between the top of the at least one cutting element and the peripheral wall, changes by less than 20% of a distance at the exit opening that is measured perpendicular to the first notional plane and centrally between the top of the at least one cutting element and the peripheral wall.

5. The implement according to claim 1, wherein the guide bar is fixed to the housing by a second fixing bolt, wherein the first fixing bolt is facing the chain sprocket and the second fixing bolt is facing the nose of the guide bar.

6. The implement according to claim 1, wherein the sidewall extends constantly along the length of the cutting chain from the second notional plane to the exit opening and centrally between the top of the at least one cutting tooth and the peripheral wall.

7. The implement according to claim 1, wherein, in the first section, a distance between the sidewall and the longitudinal edge of the at least one cutting element is smaller at the exit opening than in the second notional plane.

8. The implement according to claim 1, wherein a distance between the sidewall and the longitudinal edge of the at least one cutting element is less than approximately 1 cm along a stretch from the second notional plane to the exit opening.

9. The implement according to claim 1, wherein in a usual set-down position of the implement a guide chamber is formed in the chain sprocket chamber above the top of the at least one cutting element, wherein the guide chamber, at the exit opening, has a mean width that is less than approximately 70% of a greatest width of the chain sprocket chamber, wherein the mean width is measured parallel to the axis of rotation of the chain sprocket centrally between the top of the at least one cutting element and the peripheral wall of the chain sprocket chamber.

10. The implement according to claim 1, wherein a distance measured at the entry opening between the top of the at least one cutting element and the peripheral wall of the chain sprocket chamber is at least approximately 1.5 cm.

11. The implement according to claim 1, further comprising a rib projecting into the chain sprocket cover and positioned adjacent to a wall of the chain sprocket cover, wherein the rib together with the wall of the chain sprocket cover forms a seal of the chain sprocket chamber.

12. The implement according to claim 1, wherein a distance measured from the top of the at least one cutting element to the peripheral wall in the plane of extension of the guide bar is less than approximately 3 cm over the entire length from the entry opening to the exit opening, except in the area of the outlet opening.

13. The implement according to claim 1, wherein the chain sprocket chamber is closed with the exception of the entry opening, the exit opening and the outlet opening.

14. The implement according to claim 1, wherein a front end of the outlet opening in the direction of travel is located at a distance of less than approximately 1 cm from a plane in which the tops of the cutting elements, forming a straight second section of the cutting chain before entering the chain sprocket chamber, are positioned.

15. The implement according to claim 1, further comprising an elastic element that is arranged at a rear side of the outlet opening in the direction of travel and delimits the rear side.

16. The implement according to claim 1, wherein the outlet opening extends over less than approximately two thirds of a width of the chain sprocket chamber measured parallel to a rotational axis of the chain sprocket.

17. The implement according to claim 1, further comprising a guide section that is arranged on the peripheral wall above the outlet opening, when viewed in the direction of travel, wherein the guide section forms an angle of more than approximately 70° with a radial to the axis of rotation of the chain sprocket.

18. The implement according to claim 1, wherein an area of the chain sprocket chamber, located beneath the cutting chain in the direction of action of gravity in the usual set-down position of the implement, is largely closed.

* * * * *